US011342718B2

(12) United States Patent
De Dios Martín et al.

(10) Patent No.: US 11,342,718 B2
(45) Date of Patent: May 24, 2022

(54) LATCH FOR TELECOMMUNICATIONS CONNECTOR

(71) Applicant: CommScope Connectivity Spain, S.L., Madrid (ES)

(72) Inventors: Longinos De Dios Martín, Barcelona (ES); Antonio Carreras García, Barcelona (ES)

(73) Assignee: CommScope Connectivity Spain, S.L., Madrid (ES)

( * ) Notice: Subject to any disclaimer, the term of this patent is extended or adjusted under 35 U.S.C. 154(b) by 0 days.

(21) Appl. No.: 15/562,385

(22) PCT Filed: Mar. 26, 2016

(86) PCT No.: PCT/ES2016/070213
§ 371 (c)(1),
(2) Date: Sep. 27, 2017

(87) PCT Pub. No.: WO2016/156644
PCT Pub. Date: Oct. 6, 2016

(65) Prior Publication Data

US 2018/0287312 A1 Oct. 4, 2018

(30) Foreign Application Priority Data

Mar. 27, 2015 (ES) ..... 201530419

(51) Int. Cl.
*H01R 13/74* (2006.01)
*H01R 13/627* (2006.01)
*H01R 24/64* (2011.01)

(52) U.S. Cl.
CPC ..... *H01R 13/745* (2013.01); *H01R 13/6275* (2013.01); *H01R 24/64* (2013.01)

(58) Field of Classification Search
CPC ..... H01R 13/745
See application file for complete search history.

(56) References Cited

U.S. PATENT DOCUMENTS 3,666,996 A 5/1972 Brown
3,739,076 A 6/1973 Schwartz
(Continued)

FOREIGN PATENT DOCUMENTS

CN 101095264 A 12/2007
CN 101510649 A 8/2009
(Continued)

OTHER PUBLICATIONS

International Search Report and Written Opinion of the International Searching Authority for corresponding International Patent Application No. PCT/ES2016/070213 dated Jun. 7, 2016, 12 pages.
(Continued)

*Primary Examiner* — Felix O Figueroa
(74) *Attorney, Agent, or Firm* — Merchant & Gould P.C.

(57) ABSTRACT

A connector assembly (10) is disclosed in which a main body (12) and a latch member (30) are provided. In one aspect, the latch member (30) is formed as a spring and has a first portion (32) with a locking rib structure (38) that can be depressed towards the main body (12) to allow the connector assembly (10) to be inserted through a front side (102*a*) or a back side (102*b*) of an opening (102) in a panel (100). After insertion, the first portion (32) can then be released such that a retention structure (18) of the main body (12) and the locking rib structure (38) engage opposite ends of an opening (102) to secure the connector assembly (10) within the opening (102). The same connector (10) assembly (10) can be used with openings (102, 202, 302) of different sizes without modification.

20 Claims, 12 Drawing Sheets

(56) References Cited

U.S. PATENT DOCUMENTS 3,830,957 A 8/1974 Oberdiear
4,284,316 A 8/1981 Debaigt
4,537,458 A 8/1985 Worth
4,660,912 A 4/1987 Tomek
4,679,879 A 7/1987 Triner et al.
4,721,476 A 1/1988 Zeliff et al.
4,747,785 A 5/1988 Roberts et al.
4,760,215 A 7/1988 Cook et al.
4,790,765 A 12/1988 Ehrenfels et al.
4,810,210 A 3/1989 Komatsu
4,824,400 A 4/1989 Spinner
4,830,628 A 5/1989 Dyson et al.
4,842,553 A 6/1989 Ingram
4,857,015 A 8/1989 Michaels et al.
5,021,610 A 6/1991 Roberts
5,169,346 A 12/1992 Johnston
5,238,416 A 8/1993 Dickie
5,240,436 A 8/1993 Bradley et al.
5,278,352 A 1/1994 Schade
5,310,359 A 5/1994 Chadbourne et al.
5,445,538 A 8/1995 Rodrigues et al.
5,571,023 A 11/1996 Anthony
5,675,126 A 10/1997 Halvorsen
5,691,506 A 11/1997 Miyazaki et al.
5,697,806 A 12/1997 Whiteman, Jr. et al.
5,762,517 A 6/1998 Abe
5,769,647 A 6/1998 Tulley et al.
6,015,307 A 1/2000 Chiu et al.
6,077,122 A 6/2000 Elkhatib et al.
6,086,415 A 7/2000 Sanchez et al.
6,244,908 B1 6/2001 Hammond et al.
6,247,849 B1 6/2001 Liu
6,254,403 B1 7/2001 Bernardini
6,292,564 B1 9/2001 Cowan et al.
6,354,851 B1 3/2002 Bachle
6,386,915 B1 5/2002 Nelson
6,394,853 B1 5/2002 Hammond et al.
6,425,694 B1 7/2002 Szilagyi et al.
6,520,781 B2 2/2003 Koide et al.
6,537,104 B1 3/2003 Hagmann et al.
6,612,750 B1 9/2003 Bull et al.
6,652,152 B2 11/2003 Yang et al.
6,702,477 B1 3/2004 Ngo
6,848,833 B1 2/2005 Kamarauskas et al.
6,866,541 B2 3/2005 Barker et al.
6,872,090 B2 3/2005 De Dios Martin
7,029,182 B2 4/2006 Ngo
7,033,219 B2 4/2006 Gordon et al.
7,087,840 B2 8/2006 Herring et al.
7,112,090 B2 9/2006 Caveney et al.
7,156,696 B1 1/2007 Montena
7,207,846 B2 4/2007 Caveney et al.
7,220,145 B2 5/2007 Denovich et al.
7,273,383 B1 9/2007 Bennett
7,329,139 B2 2/2008 Benham
7,340,146 B2 3/2008 Lampert et al.
7,384,298 B2 * 6/2008 Caveney ..... H01R 13/58 439/404
7,416,448 B2 8/2008 Gaidosch
7,476,120 B2 1/2009 Patel et al.
7,510,421 B2 3/2009 Fransen et al.
7,621,772 B1 11/2009 Tobey
7,628,644 B1 12/2009 Peluffo
7,628,657 B2 12/2009 Martich
7,637,769 B2 12/2009 Carreras Garcia et al.
7,645,160 B2 1/2010 Tabet
7,676,133 B2 3/2010 Lampert et al.
7,727,013 B1 6/2010 Paynter
7,766,688 B2 8/2010 Mateo Ferrus et al.
7,806,721 B2 10/2010 Herndon et al.
7,819,698 B2 10/2010 Islam
7,854,624 B1 12/2010 Pepe
7,857,663 B2 12/2010 Chantrell et al.
7,871,285 B1 1/2011 Tobey et al.
7,874,865 B2 1/2011 Tobey
7,909,622 B2 3/2011 Pepe et al.
7,938,680 B1 5/2011 Hsieh
7,955,120 B2 6/2011 Patel et al.
8,057,249 B1 11/2011 Tobey et al.
8,070,506 B2 12/2011 De Dios Martin et al.
8,075,344 B2 12/2011 Shih
8,109,784 B2 2/2012 Patel et al.
8,241,055 B2 8/2012 Chen
8,376,786 B2 * 2/2013 Carreras Garcia .. H01R 13/187 439/382
8,454,383 B2 6/2013 Paynter et al.
8,747,126 B2 6/2014 Corbett et al.
8,758,065 B2 6/2014 Fransen et al.
8,791,374 B1 7/2014 Smith
8,834,196 B2 9/2014 Duran et al.
9,022,792 B2 5/2015 Sticker et al.
9,583,885 B2 2/2017 Ruesca Fernandez
9,627,827 B2 4/2017 Bragg
9,640,898 B1 5/2017 Wubbels
9,768,556 B2 9/2017 Bopp et al.
9,847,607 B2 12/2017 Bopp et al.
10,476,212 B2 11/2019 Bopp et al.
10,522,939 B2 12/2019 De Dios Martin
10,594,088 B2 3/2020 Cuppies et al.
10,651,608 B2 5/2020 White
10,777,953 B2 9/2020 White et al.
10,784,640 B2 9/2020 Font Aranega et al.
10,958,012 B2 3/2021 De Dios Martin
2002/0058432 A1 5/2002 Chen et al.
2002/0119681 A1 8/2002 Follingstad et al.
2003/0081907 A1 5/2003 Malagrino, Jr. et al.
2004/0038582 A1 2/2004 Clement
2004/0229501 A1 11/2004 Caveney et al.
2005/0103672 A1 5/2005 Peng
2005/0159036 A1 7/2005 Caveney et al.
2005/0201071 A1 9/2005 AbuGhazaleh et al.
2006/0110986 A1 5/2006 King, Jr. et al.
2006/0204200 A1 9/2006 Lampert et al.
2007/0054521 A1 3/2007 John
2007/0240902 A1 10/2007 Tapper
2008/0090461 A1 4/2008 Pepe et al.
2008/0096438 A1 4/2008 Clark et al.
2008/0102686 A1 5/2008 Carreras Garcia et al.
2008/0268719 A1 10/2008 Siemon et al.
2008/0311800 A1 12/2008 Tsai
2009/0004913 A1 1/2009 Caveney et al.
2009/0034226 A1 2/2009 Herndon et al.
2009/0243757 A1 10/2009 Xu et al.
2009/0258545 A1 10/2009 Pepe et al.
2009/0274422 A1 11/2009 Henry et al.
2009/0311904 A1 12/2009 Chen
2009/0318033 A1 12/2009 Tobey
2010/0151707 A1 6/2010 AbuGhazaleh et al.
2010/0216335 A1 8/2010 Cobb
2010/0255716 A1 10/2010 Frey et al.
2011/0030343 A1 2/2011 Kiser et al.
2011/0038581 A1 2/2011 Mudd et al.
2011/0097924 A1 4/2011 Chen
2011/0115494 A1 5/2011 Taylor et al.
2011/0304343 A1 12/2011 Font Aranega et al.
2012/0196472 A1 8/2012 Fitzpatrick
2012/0226807 A1 9/2012 Panella et al.
2012/0244736 A1 9/2012 Duran et al.
2012/0244752 A1 9/2012 Patel et al.
2012/0322307 A1 12/2012 Kudo
2013/0203291 A1 8/2013 Sticker et al.
2013/0210264 A1 8/2013 Rynaski et al.
2013/0217249 A1 8/2013 Patel et al.
2013/0260582 A1 10/2013 White
2014/0080354 A1 3/2014 Caveney et al.
2014/0242855 A1 8/2014 Kan et al.
2014/0287609 A1 9/2014 Fransen et al.
2014/0335726 A1 11/2014 Zhang
2015/0349468 A1 12/2015 Singer et al.
2016/0080836 A1 3/2016 Carreras Garcia
2016/0248197 A1 8/2016 Fransen et al.
2016/0285205 A1 9/2016 Ruesca Fernandez
2017/0229825 A1 8/2017 Baines et al.
2017/0302040 A1 10/2017 Taylor et al.

(56) References Cited

U.S. PATENT DOCUMENTS

| | | | |
|---|---|---|---|
| 2018/0358739 | A1 | 12/2018 | De Dios Martin |
| 2020/0137465 | A1 | 4/2020 | White et al. |
| 2020/0244003 | A1 | 7/2020 | De Dios Martin |
| 2020/0267862 | A1 | 8/2020 | Taguchi et al. |
| 2020/0351573 | A1 | 11/2020 | Shih |
| 2021/0104850 | A1 | 4/2021 | White et al. |
| 2021/0143600 | A1 | 5/2021 | Font Aranega et al. |
| 2021/0281009 | A1 | 9/2021 | De Dios Martin |

FOREIGN PATENT DOCUMENTS

| | | | |
|---|---|---|---|
| CN | 201303074 | Y | 9/2009 |
| CN | 201741918 | U | 2/2011 |
| CN | 201774068 | U | 3/2011 |
| CN | 202025948 | U | 11/2011 |
| CN | 102957034 | A | 3/2013 |
| CN | 203218574 | U | 9/2013 |
| CN | 103384042 | A | 11/2013 |
| DE | 101 13 230 | A1 | 9/2002 |
| EP | 0 073 112 | A1 | 3/1983 |
| EP | 0 775 845 | A2 | 5/1997 |
| EP | 1 189 085 | A2 | 3/2002 |
| EP | 1 422 793 | A1 | 5/2004 |
| EP | 1 443 608 | A2 | 8/2004 |
| EP | 1 484 824 | A2 | 12/2004 |
| EP | 2 133 957 | A1 | 12/2009 |
| ES | 2 178 813 | T3 | 1/2003 |
| ES | 2 257 514 | T3 | 8/2006 |
| ES | 1 138 538 | U | 4/2015 |
| ES | 2 583 636 | A1 | 9/2016 |
| ES | 2 584 539 | A1 | 9/2016 |
| ES | 2 600 968 | A1 | 2/2017 |
| FR | 2 701 007 | A1 | 8/1994 |
| FR | 2 893 454 | A1 | 5/2007 |
| GB | 221872 | A | 9/1924 |
| GB | 2 260 660 | A | 4/1993 |
| GB | 2 308 508 | A | 6/1997 |
| GB | 2 457 982 | A | 9/2009 |
| GB | 2 469 123 | A | 10/2010 |
| JP | 2001-244029 | A | 9/2001 |
| JP | 2006-126807 | A | 5/2006 |
| JP | 2007-299620 | A | 11/2007 |
| JP | 2007-313060 | A | 12/2007 |
| JP | 2013-235783 | A | 11/2013 |
| KR | 2001-0100594 | A | 11/2001 |
| KR | 20-2010-0008888 | U | 9/2010 |
| TW | M349117 | U | 1/2009 |
| WO | 95/34923 | A1 | 12/1995 |
| WO | 97/44862 | A1 | 11/1997 |
| WO | 99/19944 | A1 | 4/1999 |
| WO | 03/026076 | A1 | 3/2003 |
| WO | 2005/104300 | A1 | 11/2005 |
| WO | 2008/059203 | A2 | 5/2008 |
| WO | 2008/095830 | A1 | 8/2008 |
| WO | 2011/038387 | A1 | 3/2011 |
| WO | 2013/090201 | A1 | 6/2013 |
| WO | 2013/096279 | A1 | 6/2013 |
| WO | 2013/123154 | A1 | 8/2013 |
| WO | 2014/167449 | A1 | 10/2014 |
| WO | 2016/151172 | A1 | 9/2016 |
| WO | 2016/151177 | A1 | 9/2016 |
| WO | 2016/156643 | A1 | 10/2016 |
| WO | 2016/156644 | A1 | 10/2016 |
| WO | 2018/009698 | A1 | 1/2018 |
| WO | 2018/034870 | A1 | 2/2018 |
| WO | 2018/236875 | A1 | 12/2018 |
| WO | 2019/094558 | A1 | 5/2019 |

OTHER PUBLICATIONS

Extended European Search Report for Application No. 20174844.9 dated Aug. 24, 2020.

Extended European Search Report for Application No. 17841856.2 dated Feb. 19, 2020.

Extended European Search Report for Application No. 18820793.0 dated Feb. 12, 2021.

International Search Report and Written Opinion for Application No. PCT/ES2016/070204 dated Jun. 6, 2016.

International Search Report and Written Opinion for Application No. PCT/ES2016/070212 dated Jun. 2, 2016.

International Search Report and Written Opinion for Application No. PCT/ES2016/070190 dated Jul. 5, 2016.

International Search Report and Written Opinion for Application No. PCT/EP2016/069310 dated Oct. 14, 2016.

International Search Report and Written Opinion for Application No. PCT/US2017/040947 dated Oct. 13, 2017.

International Search Report and Written Opinion for Application No. PCT/US2017/045539 dated Nov. 15, 2017.

International Search Report and Written Opinion for Application No. PCT/US2018/038295 dated Oct. 16, 2018.

International Search Report and Written Opinion for Application No. PCT/US2018/059775 dated Mar. 4, 2019.

Product Specifications: 1-1479191-3, SL Series Speaker Post Insert, red stripe, alpine white, CommScope, Inc., 1 page (Sep. 6, 2017).

State of the Art Report for Application No. 201530372 dated Mar. 20, 2015.

State of the Art Report for Application No. 201530377 dated Mar. 23, 2015.

State of the Art Report for Application No. 201530417 dated Mar. 27, 2015.

State of the Art Report for Application No. 201530418 dated Mar. 27, 2015.

State of the Art Report for Application No. 201530419 dated Mar. 27, 2015.

State of the Art Report for Application No. 201531199 dated Aug. 13, 2015.

Extended European Search Report for Application No. 18875839.5 dated Jul. 19, 2021.

First Office Action for Chinese Patent Application No. 201880072621.7 dated Aug. 17, 2021, 21 pages.

International Search Report and Written Opinion of the International Searching Authority for International Patent Application No. PCT/US2018/059780 dated Mar. 4, 2019, 12 pages.

"Mini-Com All Metal Shielded Modular Patch Panels, Installation Instructions", Panduit, 2 pages (2010).

"Mini-Com® All Metal Shielded Modular Patch Panels, Installation Instructions, Specification Sheet", Panduit, 3 pages (2016).

* cited by examiner

LATCH FOR TELECOMMUNICATIONS CONNECTOR

CROSS-REFERENCE TO RELATED APPLICATION

This application is a National Stage Application of PCT/ES2016/070213, filed on Mar. 26, 2016, which claims the benefit of Spanish Patent Application No. P201530419, filed on Mar. 27, 2015, the disclosures of which are incorporated herein by reference in their entireties. To the extent appropriate, a claim of priority is made to each of the above disclosed applications.

BACKGROUND

Electrical connectors are useful for providing a connection point for telecommunications systems. For example, RJ-type connectors can be provided as wall sockets wherein electronic data cables are terminated and mating electrical plugs can be inserted into the sockets. Various installation environments require connectors of different types such that the connector can be installed into a specifically sized opening or be installed from a front or back direction. Improvements are desired.

SUMMARY

A connector assembly is disclosed. In one aspect, the connector assembly includes a main body defining a jack cavity operably connected to a cable having a plurality of wires. In another aspect, the connector assembly includes a latch member connectable to the main body, wherein the latch member enables the connector assembly to be installed into an opening from a front or back side of the opening and wherein the latch member enables the connector assembly to be installed into openings of various sizes. In one aspect, the latch member is formed as a spring having a first portion with a locking rib structure at a free end. In one aspect, the first portion and locking rib structure can be depressed towards the main body to allow the connector assembly to be inserted through a front side or a back side of an opening in a panel and can be released such that the first retention structure and the locking rib structure engage opposite ends of the opening to secure the connector assembly within the opening.

A method for installing a connector assembly into an opening of a panel is also disclosed. The method can include the steps of providing a connector assembly of the aforementioned type; depressing the first portion and locking rib structure towards the main body; inserting the connector assembly into the opening; and releasing the first portion to allow the locking rib structure and first retention structure to engage the panel to secure the connector assembly within the opening.

BRIEF DESCRIPTION OF THE DRAWINGS

Non-limiting and non-exhaustive embodiments are described with reference to the following figures, which are not necessarily drawn to scale, wherein like reference numerals refer to like parts throughout the various views unless otherwise specified.

DETAILED DESCRIPTION

Figure 1:
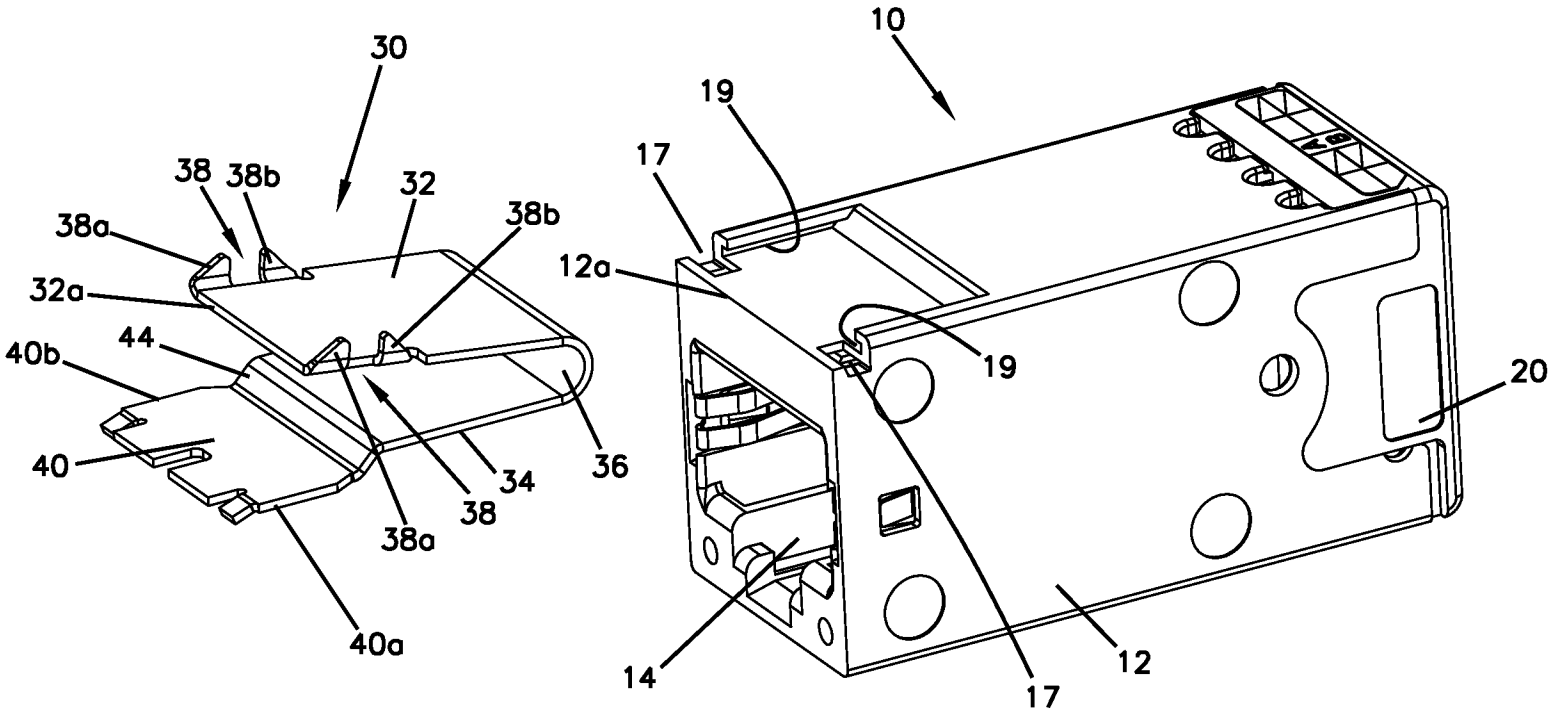
FIG. 1 is a front perspective view of a telecommunications connector assembly having a main body and a separated latch member having features that are examples of aspects in accordance with the principles of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

A telecommunications connector assembly 10 is disclosed for connection with a cable 4 having a sheath 5 and a plurality of wires 6 is shown. In some examples, the sheath 5 can be formed from a metal braid, mesh, or foil. In one example, the cable 4 includes a plurality of insulated copper wires 6 while the connector assembly includes a main body 12 configured as a modular or RJ-type connector. As shown, the telecommunications connector main body 12 includes a jack cavity 14 for receiving a corresponding plug (not shown). In one aspect the main body 12 includes a plurality of electrical contact members 16 for which electrical connection to the wires 6 is made. In one aspect, the connector assembly 10 can include a cable management part 20 connected to the main body 12 for receiving and retaining the wires 6 from the cable 4 such that the wires 6 can be properly terminated to the connector assembly 10. The main body 12 can also be provided with a retention structure 18 having members 18*a* and 18*b*, opposite the latch member 30, to further secure the connector assembly 10 within the opening 102.

In one aspect, the telecommunications connector assembly 10 includes a latch member 30 that can be removably attached to the main body 12. The latch member 30 is for securing the connector assembly 10 within an opening 102 of a connector panel 100. In one example, the latch member 30 is a unitary structure formed from a metal material, such as steel. A plastic material may also be used, although metal is preferred due to more suitable strength and flexibility properties, and because metal allows the latch member 30 to be made from a relatively thin material. Where metal is used, the latch member 30 can also serve to provide a grounding pathway.

Figure 3:
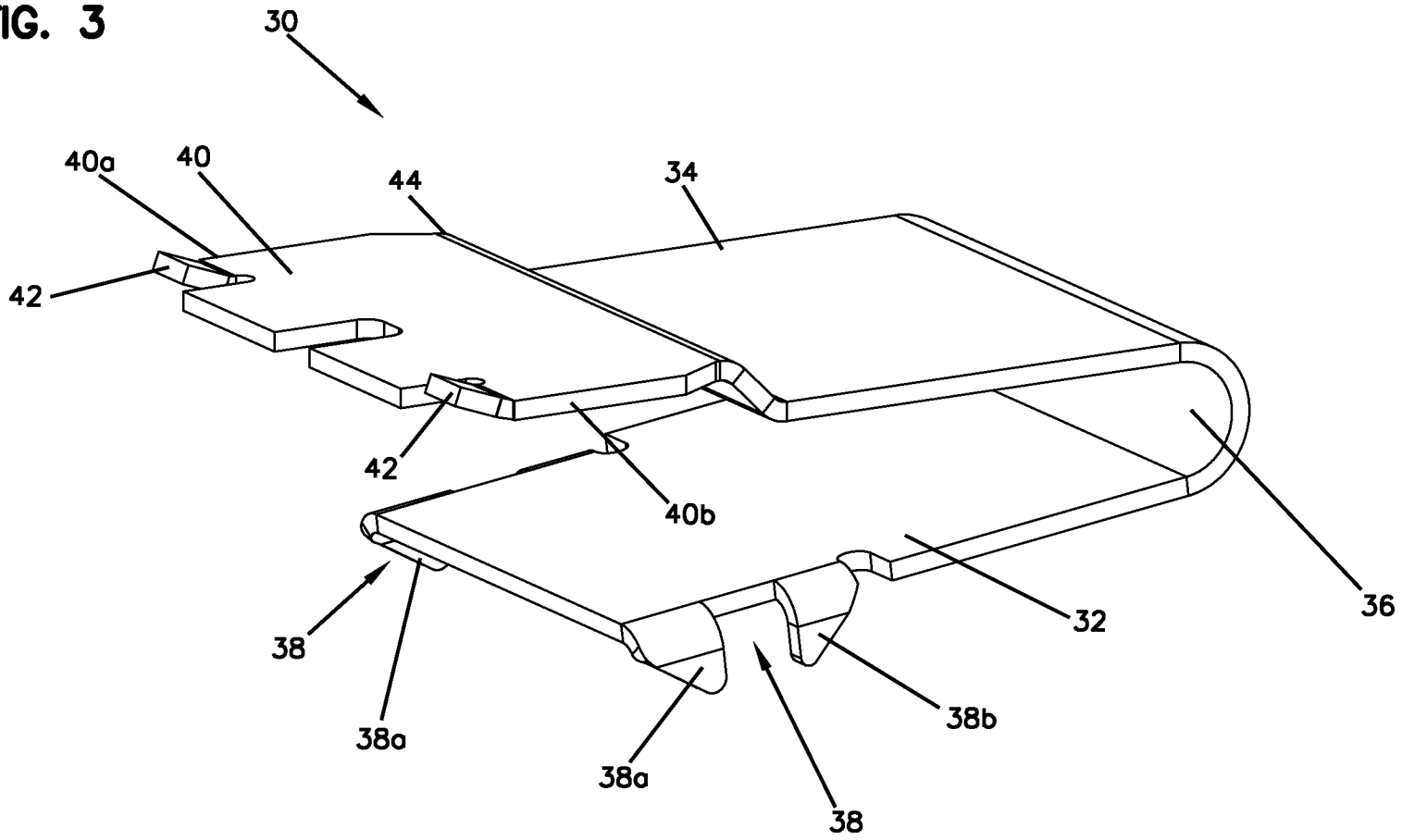
FIG. 3 is a bottom front perspective view of the latch member shown in FIG. 1.
Figure 4:
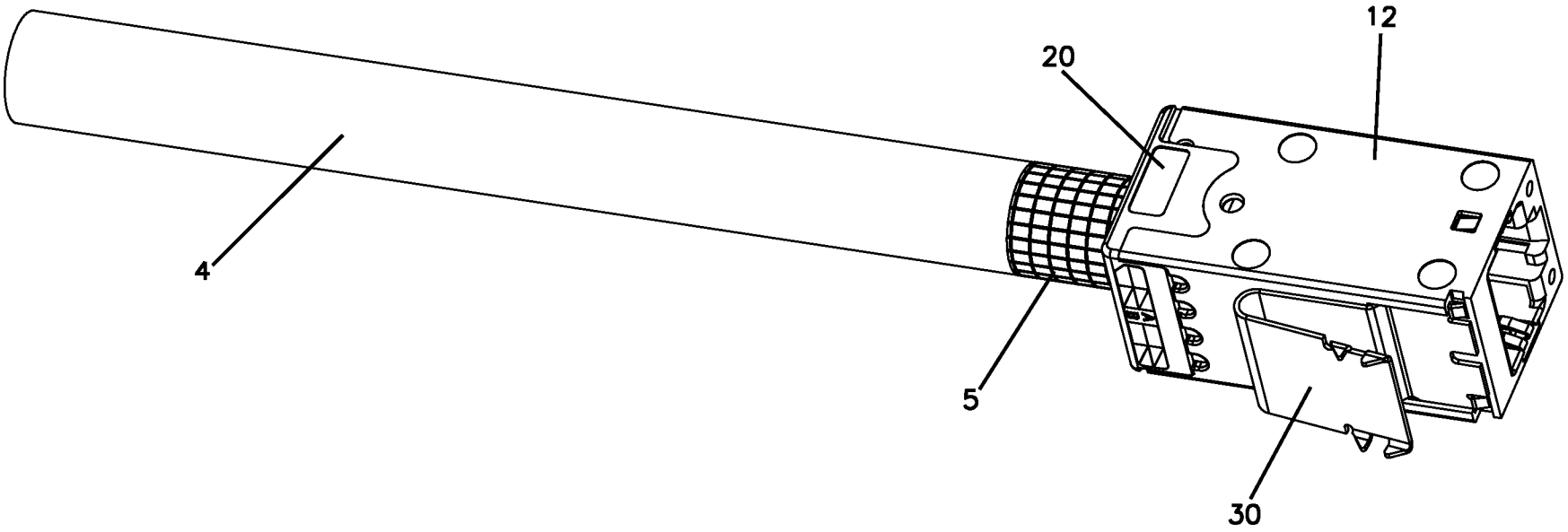
FIG. 4 is a front perspective view of the assembled connector assembly shown in FIG. 2 that has been terminated to a cable.
Figure 5:
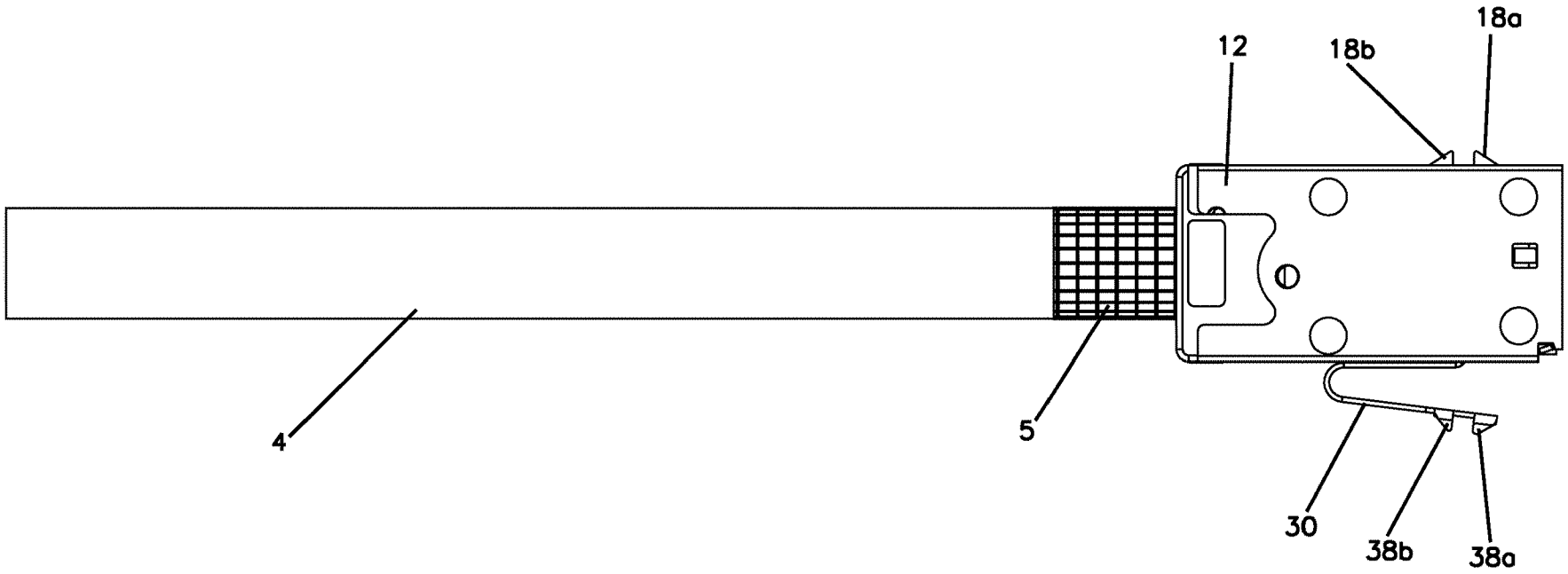
FIG. 5 is a side view of the assembled connector assembly and cable shown in FIG. 4.

As most easily seen at FIGS. 1 and 3, the latch member 30 can be provided with a first portion 32 and a second portion 34 that are joined by a third portion 36. As presented, the third portion 36 is curved or represents a bent portion of the latch member 30 such that the third portion 36 enables the latch member to perform a spring function. As shown, the third portion 36 holds the first portion 32 at an non-zero angle with respect to the second portion 34.

In one aspect, the first portion 32 includes a pair of locking rib structures 38, wherein each of the locking ribs includes a first rib 38*a* and a spaced apart second rib 38*b*. The locking rib structures 38 are for engaging with the connector panel 100 adjacent the opening 102. Once installed, the first ribs 38*a* engage a front side 100*a* of the connector panel 100 while the second ribs 38*b* engage a back side 100*b* of the connector panel 100 such that the connector assembly 10 is locked in place into the opening 102.

Figure 2:
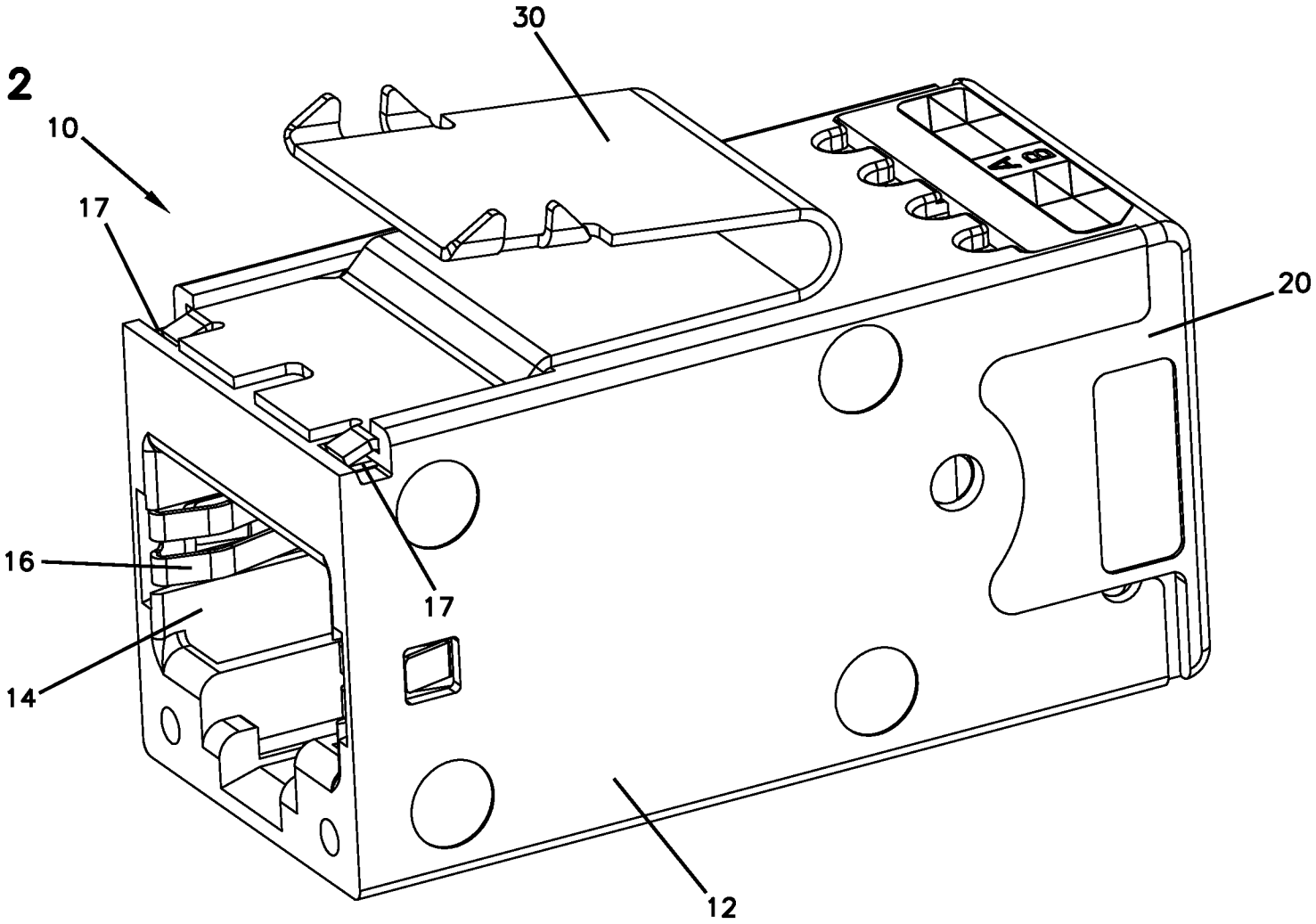
FIG. 2 is a front perspective view of the telecommunications connector assembly shown in FIG. 1 with the latch member having been joined to the main body.

In another aspect, the second portion 34 includes a retention structure 40. The retention structure 40 is for providing a secure connection between the latch member 30 and the main body 12 of the connector assembly 10. As shown, the retention structure 40 includes a pair of tabs 42. The tabs 42 are disposed at an angle relative to remainder of the retention structure 40, thereby creating a height difference between the tabs 42 and the remainder of the retention structure 40. With reference to FIG. 1, it can be seen that the main body 12 is provided with a pair of slot structures 19 which are configured for receiving the side edges 40*a*, 40*b* of the retention structure up to the tabs 42. To facilitate installation of the latch member 30 onto the main body 12, the retention structure 40 also includes a ramped section 44 to offset the retention structure from the remaining portion of the second portion 34. This offset allows the latch member 30 to be installed such that at least part of the second portion 34 can be adjacent to the main body 12, as shown in FIG. 2.

Referring to FIG. 1, it can be seen that the latch member 30 is aligned with the main body 12 such that the side edges 40*a*, 40*b* of the retention structure 40 can slide into the respective slot structures 19. As the side edges 40*a*, 40*b* enter the slot structures 19 and the latch member 30 is pushed in a direction towards the cable manager part 20, the tabs 42 will eventually elastically deform over the top edge 12*a* of the main body 12 and snap down into cavities 17 located in the main body 12. Once the tabs 42 are within the cavities 17, the latch member 30 is secured to the connector main body 12 such that the latch member 30 cannot be displaced in a direction towards the cavity 14. Other approaches for attaching the latch member 30 to the main body 12 may also be used without departing from the concepts disclosed herein, for example, fasteners, adhesives, differently configured tabs, barbs, and other methods and structures may be utilized.

Figure 6:
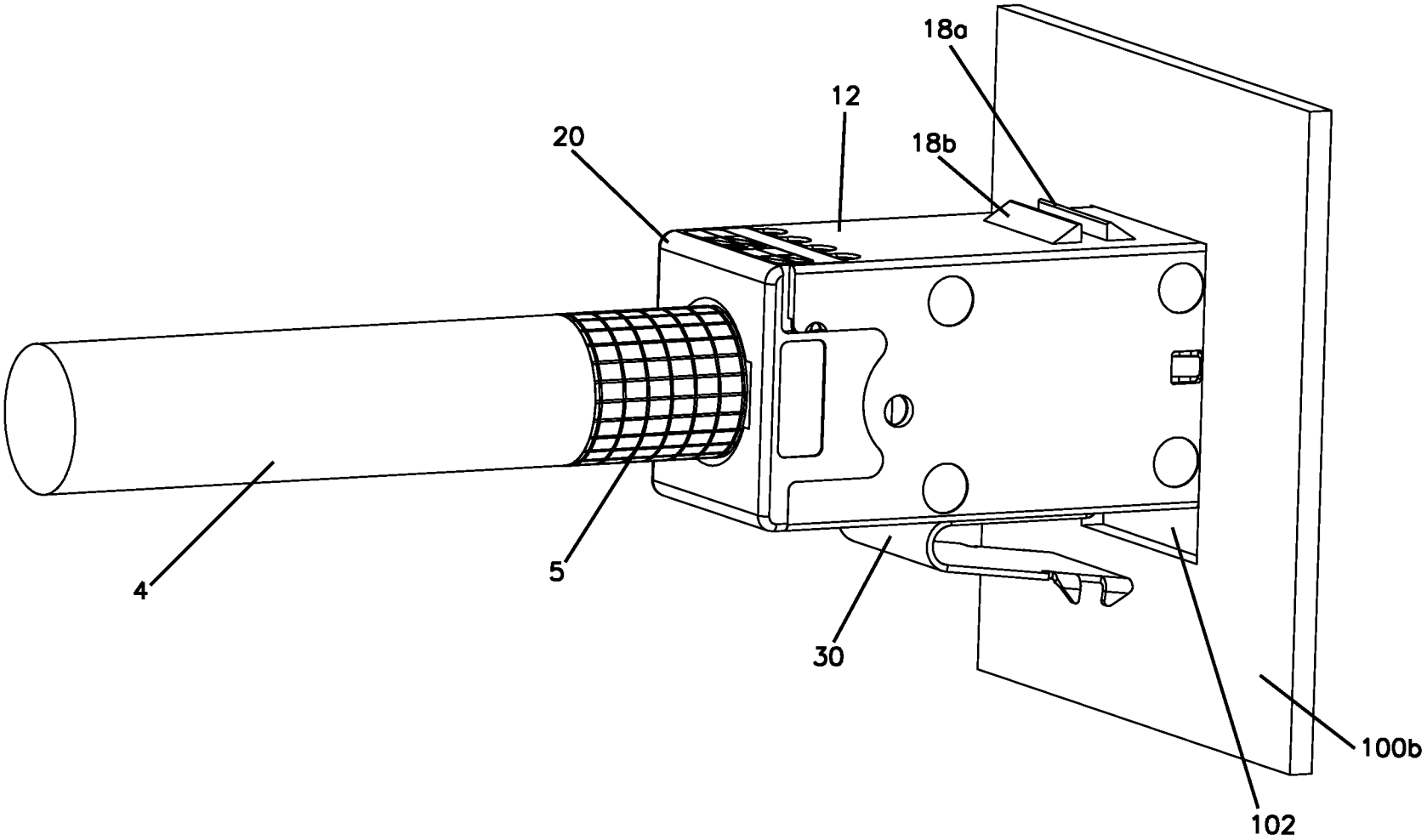
FIG. 6 is a rear perspective view of the assembled connector assembly and cable shown in FIG. 4 being inserted into a first opening of a first connection panel, from the back side of a connection panel.
Figure 7:
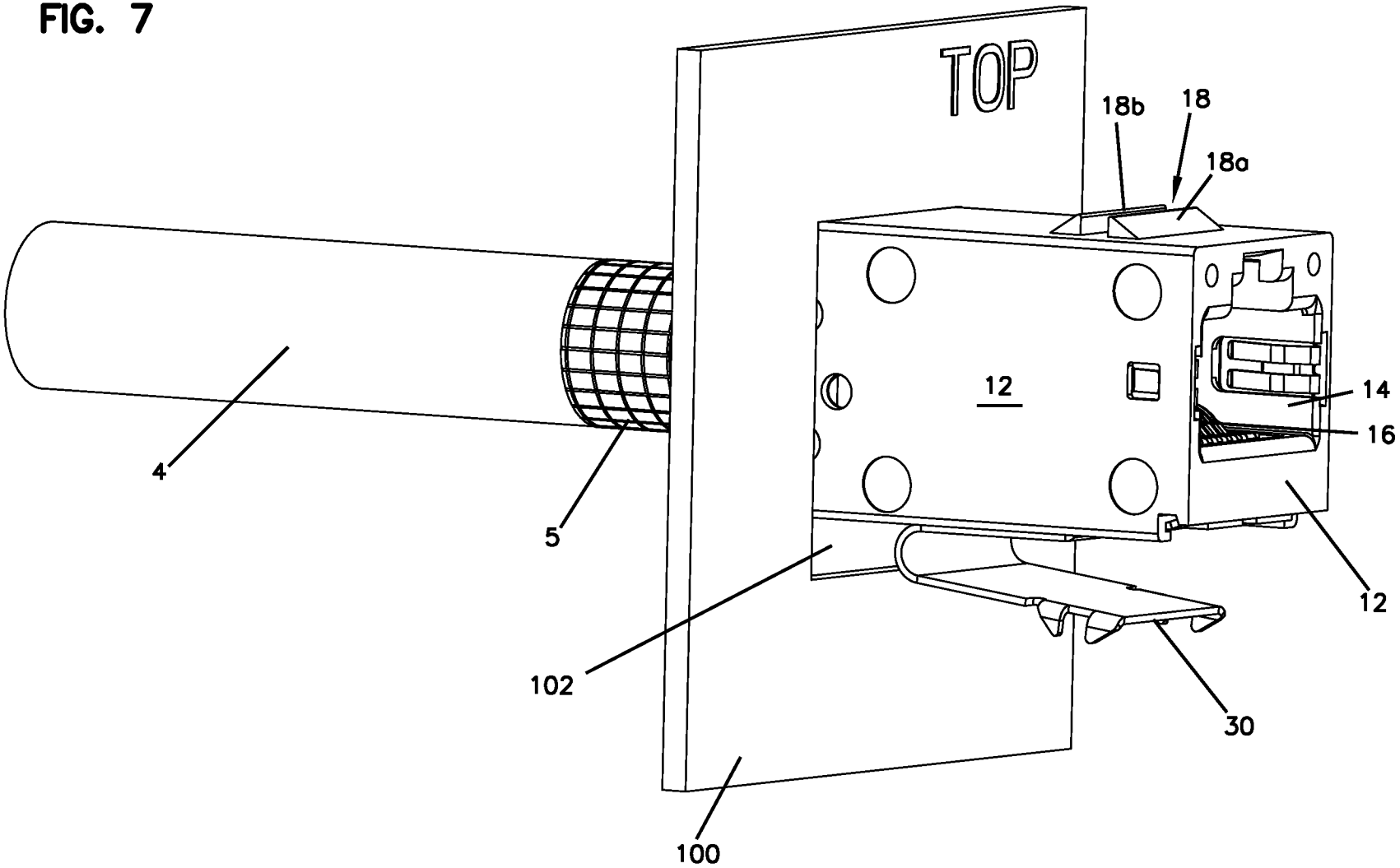
FIG. 7 is a front perspective view of the assembled connector assembly and cable shown in FIG. 4 being inserted into the first opening from the front side of the first connection panel shown in FIG. 6.

Referring to FIG. 6, it can be seen that the connector assembly 10 can be installed from a back side 100*b* of a connection panel 100 and into an opening 102. FIG. 7 shows that the connector assembly 10 can also be installed from a front side 100*a* of the connection panel 100 into the opening 102. This feature of being able to insert the connector assembly 10 into the opening 102 from either side of the plate 100 is an improvement over prior art connectors that can only be inserted from one direction.

Figure 8:
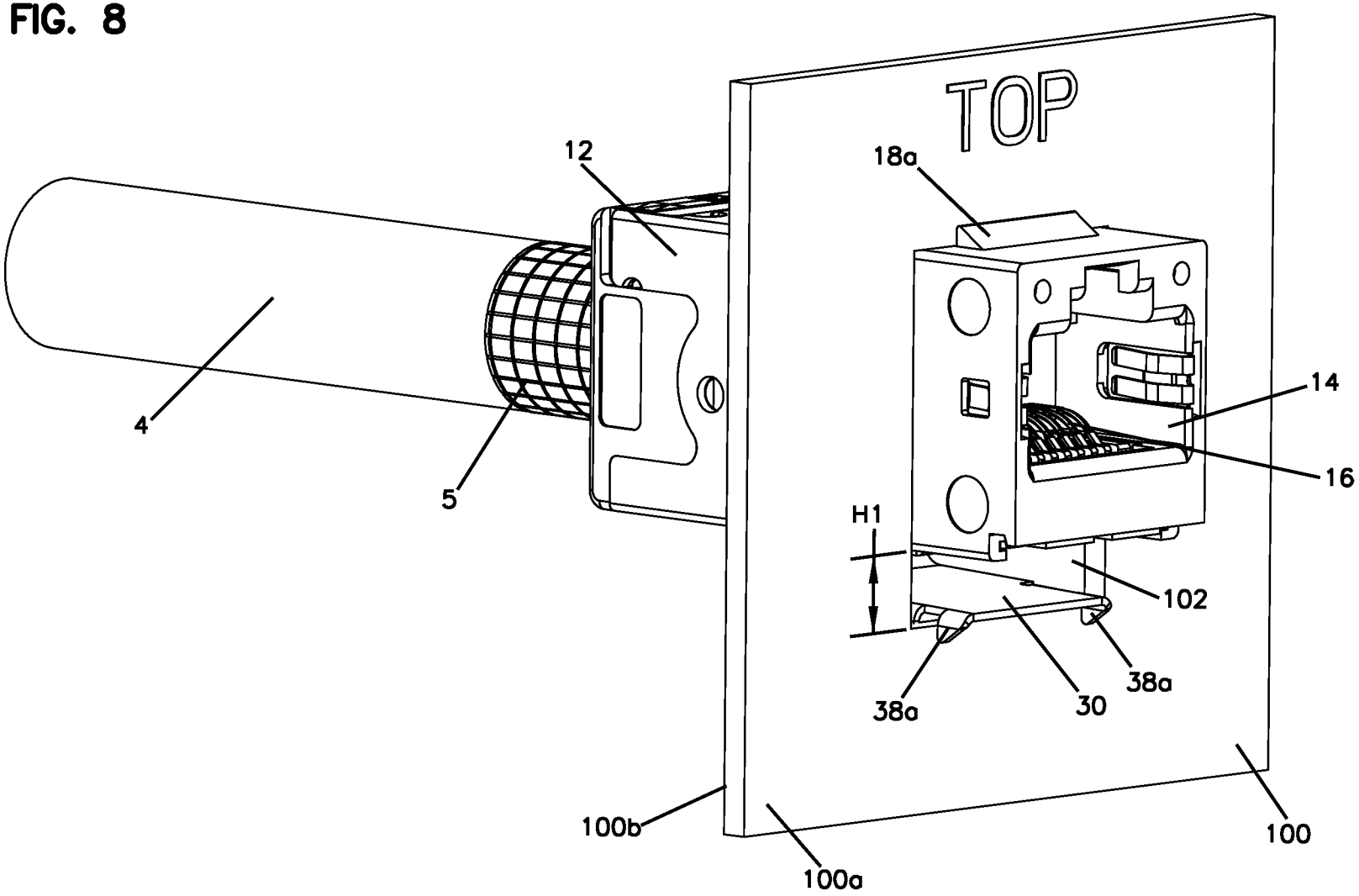
FIG. 8 is a front perspective view of the assembled connector assembly and cable shown in FIG. 4 after having been installed into the connection panel opening shown in FIGS. 6 and 7.

As can be seen at FIG. 8, the connector assembly 10 has been fully installed into the opening 102 (from either direction) such that the ribs 38*a* and retention member 18*a* are secured against the first side 100*a* of the plate 100 and such that ribs 38*b* and retention member 18*b* are secured against the second side 100*b* of the plate 100. In order to move the connector assembly 10 from either of the positions shown in FIG. 6 or 7, a user simply depresses the free end 32*a* of the first portion 32 of the latch member 30 towards the main body 12 until enough clearance exists to insert tabs 38*a* or 38*b* (depending on direction of insertion) through the opening 102. Once this position has been reached, the user can release the first portion 32 and the spring action caused by the third portion 36 will urge the main body 12 towards the top of the opening 102. At this point, the connector assembly 10 is secured to the plate 100.

Figure 9:
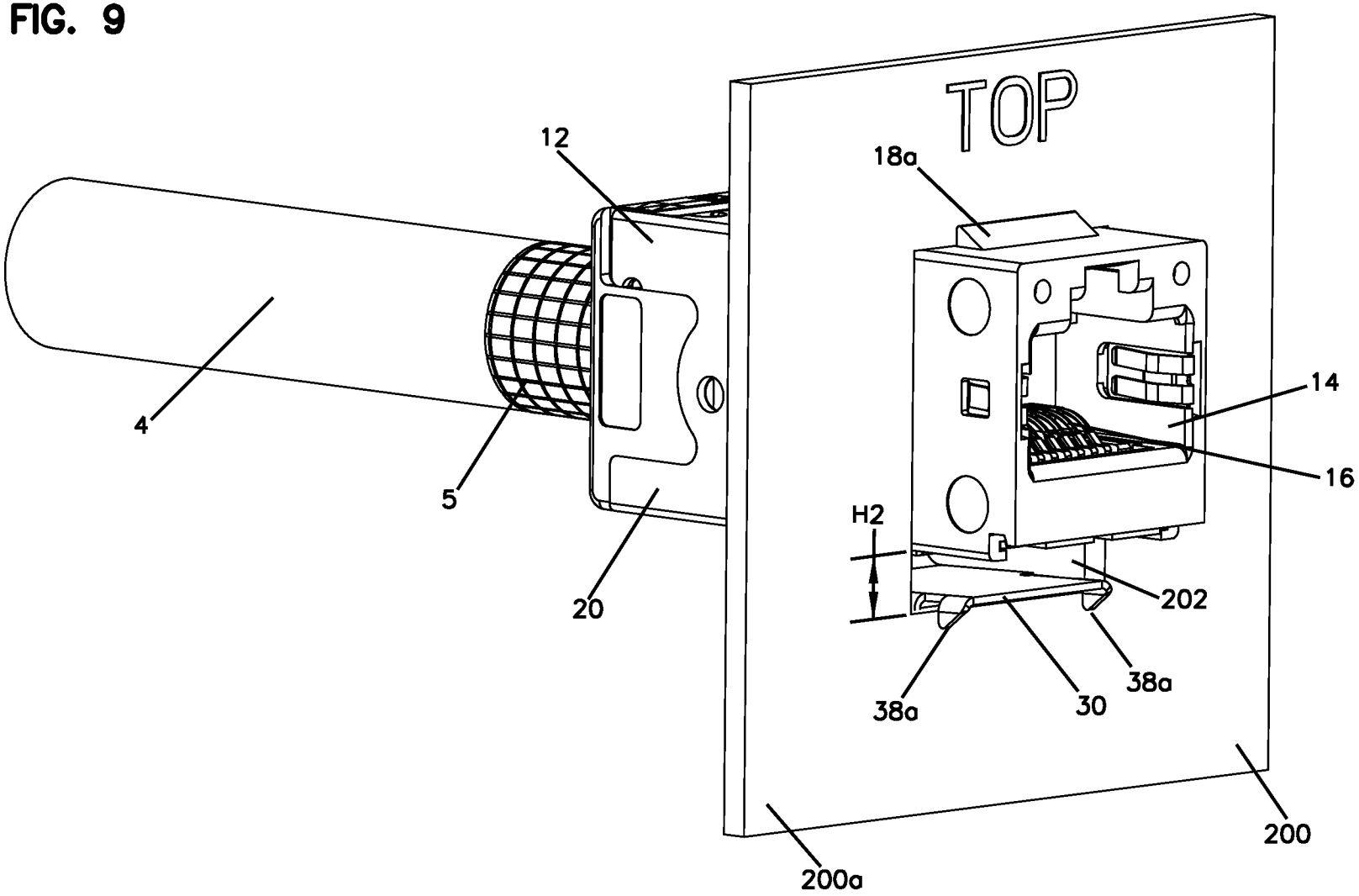
FIG. 9 is a front perspective view of the assembled connector assembly and cable shown in FIG. 4 having been installed into a second connection panel having a second opening size.
Figure 10:
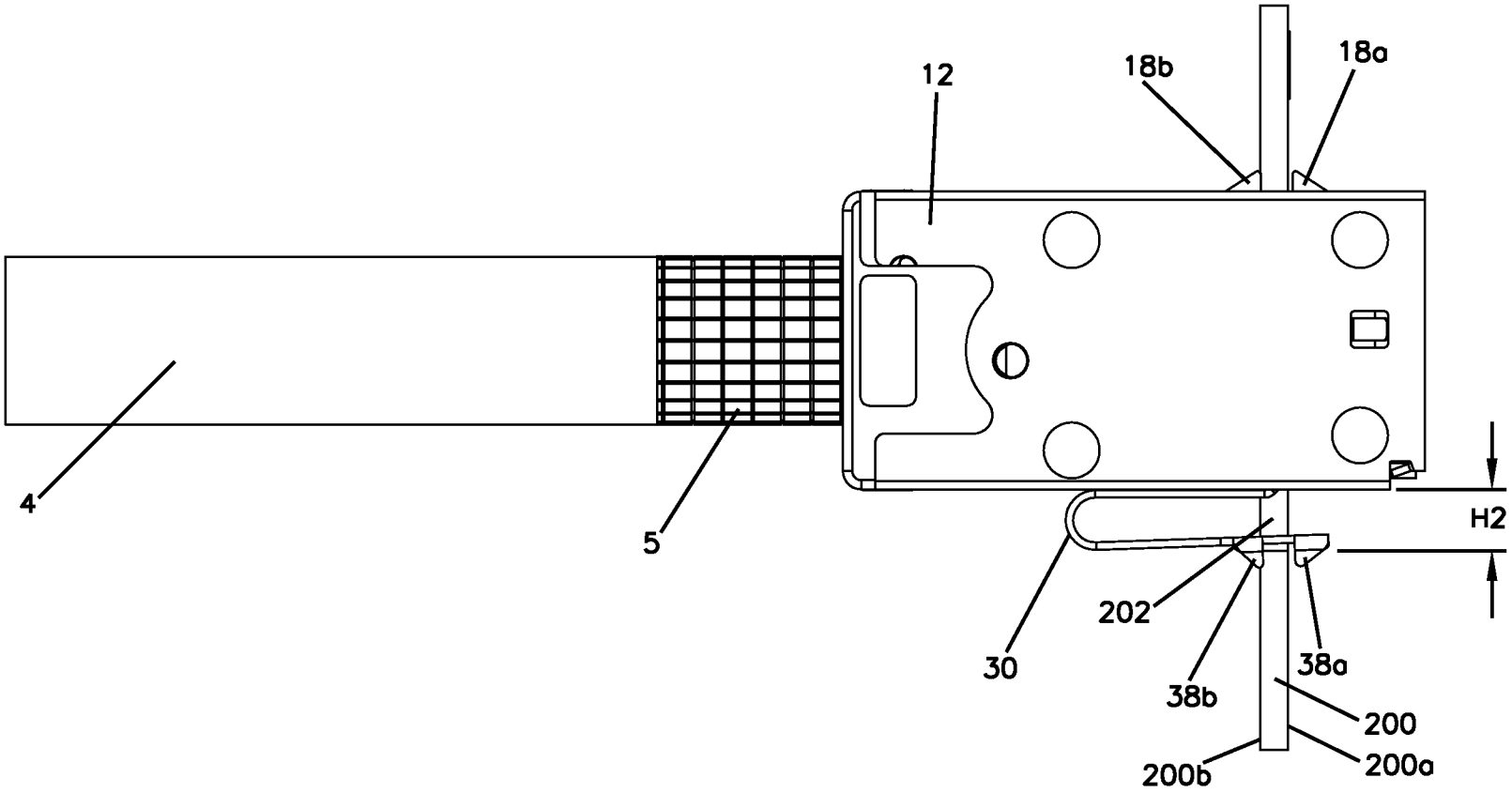
FIG. 10 is a side view of the assembled connector assembly, cable, and second connection panel shown in FIG. 9.
Figure 11:
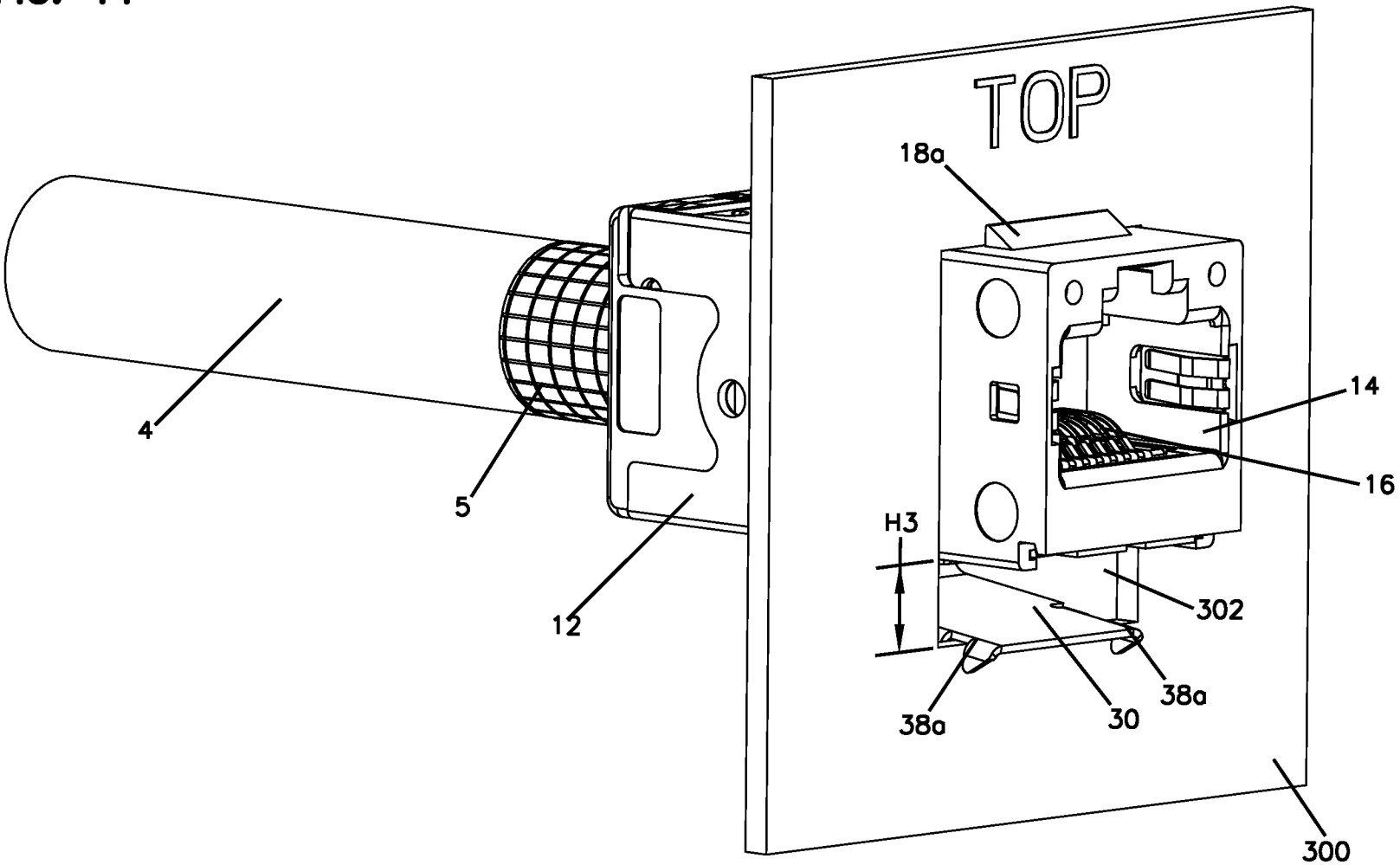
FIG. 11 is a front perspective view of the assembled connector assembly and cable shown in FIG. 4 having been installed into a third connection panel having a third opening size.
Figure 12:
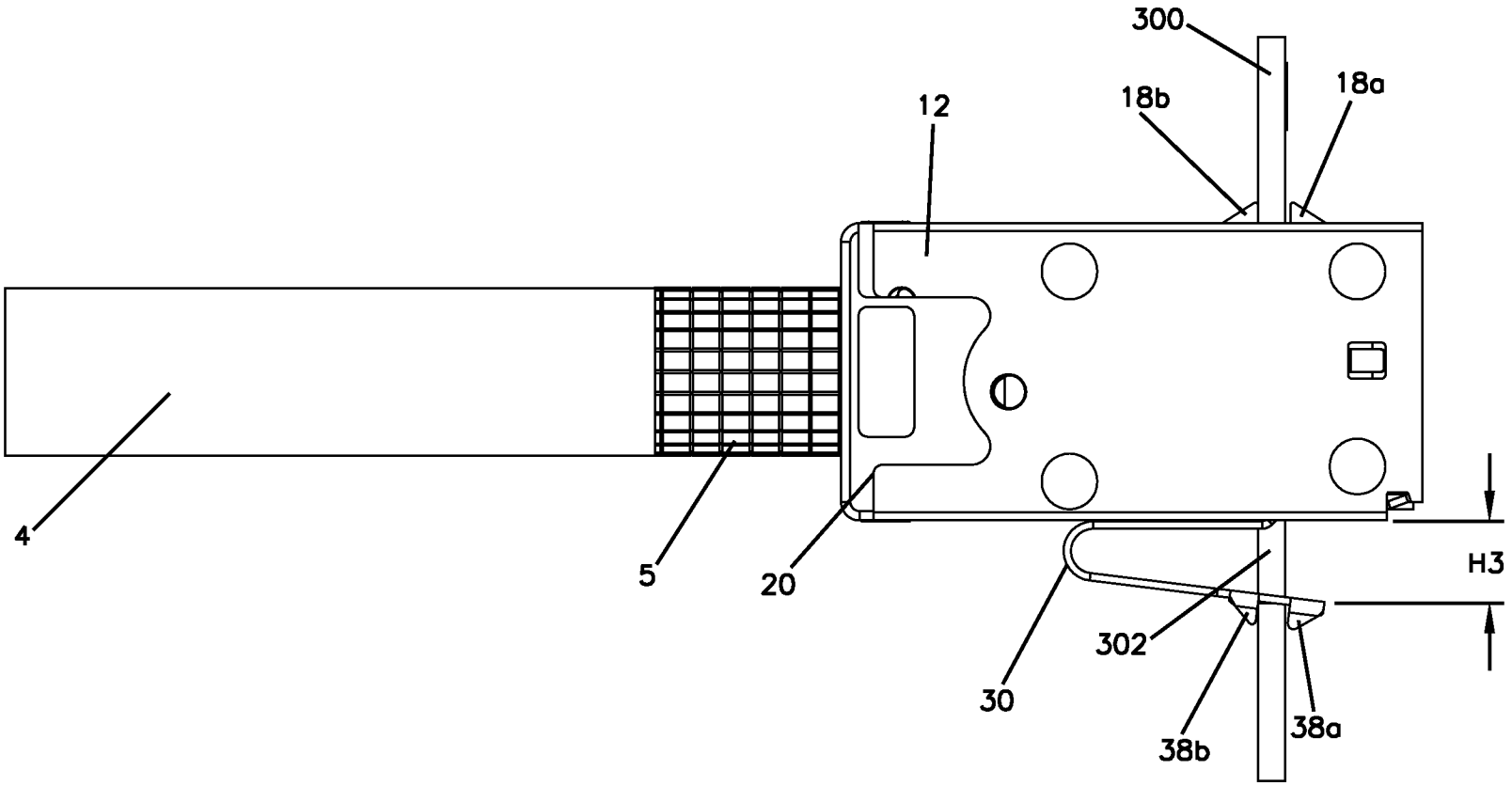
FIG. 12 is a side view of the assembled connector assembly, cable, and third connection panel shown in FIG. 11.

A primary benefit of the disclosed structure having a spring-type latch member 30 and a low profile main body 12 is that the same connector assembly 10 can be installed in panel openings of various different sizes. For example, in the embodiment shown at FIG. 8, a remaining height H1 exists between the main body 12 and the bottom of the opening 102 that can be accommodated by the latch. Referring to FIGS. 9 and 10, the same connector assembly 10 is shown as being connected to a different plate 200 having an opening 202 that is smaller than opening 102, resulting in a remaining height H2 that is less than height H1. Referring to FIGS. 11 and 12, the same connector assembly 10 is shown as being connected to yet another plate 300 having an opening 302 that is larger than opening 102, resulting in a remaining height H3 that is more than height H1. In one example, connector assembly 10 can be mounted into plates having opening heights of 19.3 millimeters (mm), 20.07 mm, and 20.6 mm, all of which are standard sized telecommunication openings that typically each require differently configured connectors.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the disclosure.

PARTS LIST

4 cable
5 sheath
6 wires or filaments
10 connector assembly
12 main body
12*a* latch tab cavity
14 jack cavity
16 electrical conductors
17 cavity
18 retention structure
18*a* first member
18*b* second member

19 channel structure
20 cable manager part
30 latch member
32 first portion
32*a* free end
34 second portion
36 third portion
38 locking rib structure
38*a* first rib
38*b* second rib
40 retention structure
40*a* first side edge
40*b* second side edge
42 tabs
44 ramped structure

What is claimed is:

1. A connector assembly comprising:

a main body having first and second side walls, a top side wall, and a bottom side wall extending from a front face to a rear face, the main body having a single jack cavity within which a plurality of electrical contact members are disposed proximate the bottom side wall, the jack cavity extending from the front face of the main body, the main body first, second, top, and bottom side walls having flat sides extending between the front and rear faces and defining a first outer perimeter proximate the jack cavity, the main body having a pair of recessed cavity portions at least partially defined on the first and second side walls, the main body having a first fixed retention structure extending beyond the first outer perimeter from the other of the top and bottom side walls;

a cable manager part connected to the main body, wherein the cable manager part has flat sides and defines a second outer perimeter matching the first outer perimeter such that no part of the cable manager part extends beyond the first outer perimeter; and a single latch member removably mounted on the top side wall of the main body and extending beyond the first outer perimeter, the latch member being formed as a flexible metal spring having a first portion joined to a second portion by a bent portion, the first portion having a locking rib structure at a free end opposite the bent portion, the locking rib structure being oppositely located from the first fixed retention structure, the second portion including a pair of bent tabs, extending from a flat portion adjacent the top side wall, received and snapped into the pair of recessed cavity portions with a snap-fit type connection, the second portion including a ramped portion extending from the flat portion and into a recess defined in the top side wall;

wherein the locking rib structure and the first fixed retention structure define a maximum overall height of the connector assembly and wherein the first portion and locking rib structure can be depressed towards the main body to reduce the maximum overall height of the connector assembly to enable the connector assembly to be inserted through a front side or a back side of an opening in a panel and can be released such that the first retention structure and the locking rib structure engage opposite ends of the opening to secure the connector assembly within the opening, and wherein the locking rib structure and first fixed retention structure enable the connector assembly to be secured within openings having different standard opening heights, including a first opening having a height of 19.3 millimeters and a second opening having a height of 20.6 millimeters.

2. The connector assembly of claim 1, wherein the bent portion has a curved shape.

3. The connector assembly of claim 2, wherein the bent portion places the first portion at a non-zero angle with respect to the second portion in a relaxed state.

4. The connector assembly of claim 1, wherein each of the pair of recessed cavities is at least partially defined within the top side wall.

5. The connector assembly of claim 1, wherein the connector assembly is an RJ-type connector.

6. The connector assembly of claim 1, wherein the latch member is removably mounted to the main body.

7. The connector assembly of claim 1, wherein the locking rib structure includes a first locking rib structure located at a first side of the first portion and a second locking rib structure being spaced apart from the first locking rib structure and located at a second side of the first portion, wherein the first and second locking rib structures each include a first rib and a spaced apart second rib.

8. A method for installing a connector assembly into an opening of a panel, the method comprising:

providing a connector assembly including:

a main body having a single jack cavity within which a plurality of electrical contact members are disposed, the main body having flat sides extending between front and rear faces of the main body and defining a first outer perimeter proximate the jack cavity and having a pair of recessed cavity portions at least partially defined on first and second side walls of the main body, the main body having a first fixed retention structure extending beyond the first outer perimeter;

a cable manager part connected to the main body, wherein the cable manager part has flat sides and defines a second outer perimeter matching the first outer perimeter such that no part of the cable manager part extends beyond the first outer perimeter; and a single latch member removably mounted on a top wall of the main body and extending beyond the first outer perimeter, the latch member being formed as a spring having a first portion with a locking rib structure at a free end, the locking rib structure being oppositely located from the first fixed retention structure, the locking rib structure and the first fixed retention structure defining a maximum overall height of the connector assembly, the latch member including a pair of bent tabs, extending from a flat portion adjacent the top wall, received and snapped into the pair of recessed cavity portions to form a snap-fit type connection, the latch member including a ramped portion extending from the flat portion and into a recess defined in the top wall, wherein the locking rib structure and first fixed retention structure enable the connector assembly to be secured within openings having different standard opening heights, including a first opening having a height of 19.3 millimeters and a second opening having a height of 20.6 millimeters;

depressing the first portion and locking rib structure towards the main body to reduce the maximum overall height of the connector assembly;

inserting the connector assembly into the opening of the panel; and releasing the first portion to allow the locking rib structure and first retention structure to engage the panel to secure the connector assembly within the opening of the panel.

9. The method of claim 8, wherein the latch member is formed from a metallic material.

10. The method of claim 8, further including elastically deflecting the bent tabs into the recessed cavities of the main body.

11. The method of claim 8, wherein the connector assembly includes an RJ-type connector.

12. The method of claim 8, further including the step of mounting the latch member to the main body.

13. The method of claim 12, wherein the step of mounting includes sliding the latch member onto the main body.

14. The method of claim 13, wherein the step of sliding includes sliding side portions of the latch member into channel structures of the main body.

15. A connector assembly comprising:

a main body having opposite first and second sidewalls and having opposite third and fourth side walls the first, second, third, and fourth side walls extending from a front face to a rear face, the main body having a jack cavity within which a plurality of electrical contact members are disposed, the jack cavity extending from the front face of the main body, wherein the main body first, second, third, and fourth side walls define a rectangular first outer perimeter portion with four flat side portions, the main body first side wall having a first fixed retention structure extending beyond the first outer perimeter; and a single latch member removably mounted to the main body and extending beyond the first outer perimeter, the latch member including an integrally formed latch body defining:

a base portion having a flat portion adjacent the first outer perimeter portion at the second side wall, and having a ramped portion extending at an oblique angle from the flat portion towards the front face and into a recess defined in the second side wall;

an attachment feature extending at a non-zero angle from the flat portion of the base and configured for mounting the latch body to the main body;

a bent portion extending from the flat portion of the base; and a locking rib structure oppositely located from the first fixed retention structure, the latch member being formed as a flexible metal spring, the locking rib structure including a first locking rib structure and a second locking rib structure spaced apart from the first locking rib structure, each of the first and second locking rib structures extending in a direction away from the main body.

16. The connector assembly of claim 15, further comprising:

a cable manager part connected to the main body, wherein the cable manager part has flat sides and defines a second outer perimeter such that no part of the cable manager part extends beyond the first outer perimeter.

17. The connector assembly of claim 15, wherein the first and second locking rib structures each include a first rib and a spaced apart second rib.

18. The connector assembly of claim 15, wherein the latch body has a first portion joined to a second portion by the bent portion, the first portion having the locking rib structure at a free end opposite the bent portion.

19. The connector assembly of claim 18, wherein the second portion includes a pair of bent tabs received and snapped into a pair of recessed cavity portions defined in the main body.

20. The connector assembly of claim 18, wherein the first and second locking rib structures are integrally formed with the first portion and extend from the first portion in a direction away from the main body.

* * * * *